US008562167B1

(12) United States Patent
Meier et al.

(10) Patent No.: US 8,562,167 B1
(45) Date of Patent: Oct. 22, 2013

(54) CABINET HAVING A LIGHT-EMITTING-TRANSLUCENT-SHELF

(75) Inventors: Peter Meier, Kernersville, NC (US); Marte Lewis Yerkins, Cleveland, NC (US)

(73) Assignee: Peter Meier Inc, LLC, Kernersville, NC (US)

( * ) Notice: Subject to any disclaimer, the term of this patent is extended or adjusted under 35 U.S.C. 154(b) by 95 days.

(21) Appl. No.: 13/290,530

(22) Filed: Nov. 7, 2011

Related U.S. Application Data

(60) Provisional application No. 61/410,403, filed on Nov. 5, 2010.

(51) Int. Cl.
*F21V 33/00* (2006.01)

(52) U.S. Cl.
USPC ..... 362/133; 362/125

(58) Field of Classification Search
USPC ..... 362/133, 125, 249.02, 92, 244, 246, 362/127
See application file for complete search history.

(56) References Cited

U.S. PATENT DOCUMENTS

| | | | | |
|---|---|---|---|---|
| 2,927,198 | A * | 3/1960 | Trott | 362/128 |
| 3,328,570 | A | 6/1967 | Balchunas | |
| 4,914,553 | A | 4/1990 | Hamada et al. | 362/32 |
| 5,584,556 | A | 12/1996 | Yokoyama et al. | 362/330 |
| 5,895,111 | A | 4/1999 | Santosuosso et al. | 362/125 |
| 5,915,824 | A | 6/1999 | Straat | 362/133 |
| 6,068,382 | A | 5/2000 | Fukui et al. | 362/31 |
| 6,283,608 | B1 | 9/2001 | Straat | 362/133 |
| 6,325,523 | B1 | 12/2001 | Santosuosso et al. | 362/125 |
| 6,619,175 | B2 | 9/2003 | Yoo | 83/875 |
| 7,018,087 | B2 | 3/2006 | Yoo | 362/615 |
| 7,163,305 | B2 | 1/2007 | Bienick | 362/92 |
| 7,766,502 | B2 | 8/2010 | Tress | 362/125 |

* cited by examiner

*Primary Examiner* — Anh T. Mai
*Assistant Examiner* — Elmito Breval
(74) *Attorney, Agent, or Firm* — MacCord Mason PLLC

(57) ABSTRACT

Cabinets having various light-emitting-translucent-shelf (LETS) are shown and described. The LETS may include at least one light-channel defined by a wooden component, at least one light source positionable within the at least one light-channel, and a translucent sheet horizontally positioned above the at least one light source.

21 Claims, 22 Drawing Sheets

CABINET HAVING A LIGHT-EMITTING-TRANSLUCENT-SHELF

RELATED APPLICATIONS

This application claims priority to U.S. Patent Application No. 61/410,403, filed Nov. 5, 2010.

FIELD

The current disclosure relates generally to cabinets and more particularly to lighted cabinets.

BACKGROUND

The use of lighting with cabinets is somewhat known. For example, some will attach lights to the bottom of kitchen cabinets to provide under-cabinet counter lighting. Further, some may attach lamps to the shelves inside of a cabinet to provide interior lighting.

For any of a variety of reasons, Applicants are dissatisfied with existing cabinet lighting systems and believe that improvements can be made in terms of at least one of function, manufacturing, and aesthetic.

SUMMARY

The current disclosure is directed to, inter alia, a cabinet having at least one light-emitting-translucent-shelf (LETS) positioned in its carcass. The LETS may include at least one light-channel defined by a wooden component, at least one light source positionable within the at least one light-channel, and a translucent sheet positioned, e.g. horizontally, above the at least one light source.

In some examples, the light source may include a light frame for mating with the LETS. Typically, the light frame will include a press arm having a top surface, a bottom surface, and a distal end, and be configured to extend into the at least one light-channel. The light frame may additionally include a first light platform, and a first plurality of LED lights positioned along the first light platform. The first platform may be configured to shine light in a variety of directions depending on the example, including, upwardly, downwardly, and both upwardly and downwardly.

In some examples, the light frame may further include a second light platform and a second plurality of LED lights positioned along the second light platform. Typically, in such examples, the first light platform will be configured to shine light at least upwardly, and the second light platform will be configured to shine light at least downwardly. Other types of lights may also be used.

Some examples, may additionally include a second translucent sheet horizontally positioned below the at least one light source.

The result includes cabinets that have a new functionality in terms of at least one of manufacturing, lighting, visualization. Applicants believe that cabinets may also provide an aesthetic that improves salability.

Cabinets as disclosed herein can be used in a variety of settings, including, for example, kitchen, bath, office, etc. In addition to cabinets, the current disclosure is also directed to LETS, and to lighting systems, e.g. light frames for use with LETS.

The above summary was intended to summarize certain embodiments of the present disclosure. Systems will be set forth in more detail in the figures and detailed description below. It will be apparent, however, that the detailed description is not intended to limit the present invention.

DETAILED DESCRIPTION OF EXEMPLARY EMBODIMENTS

Figure 1A:
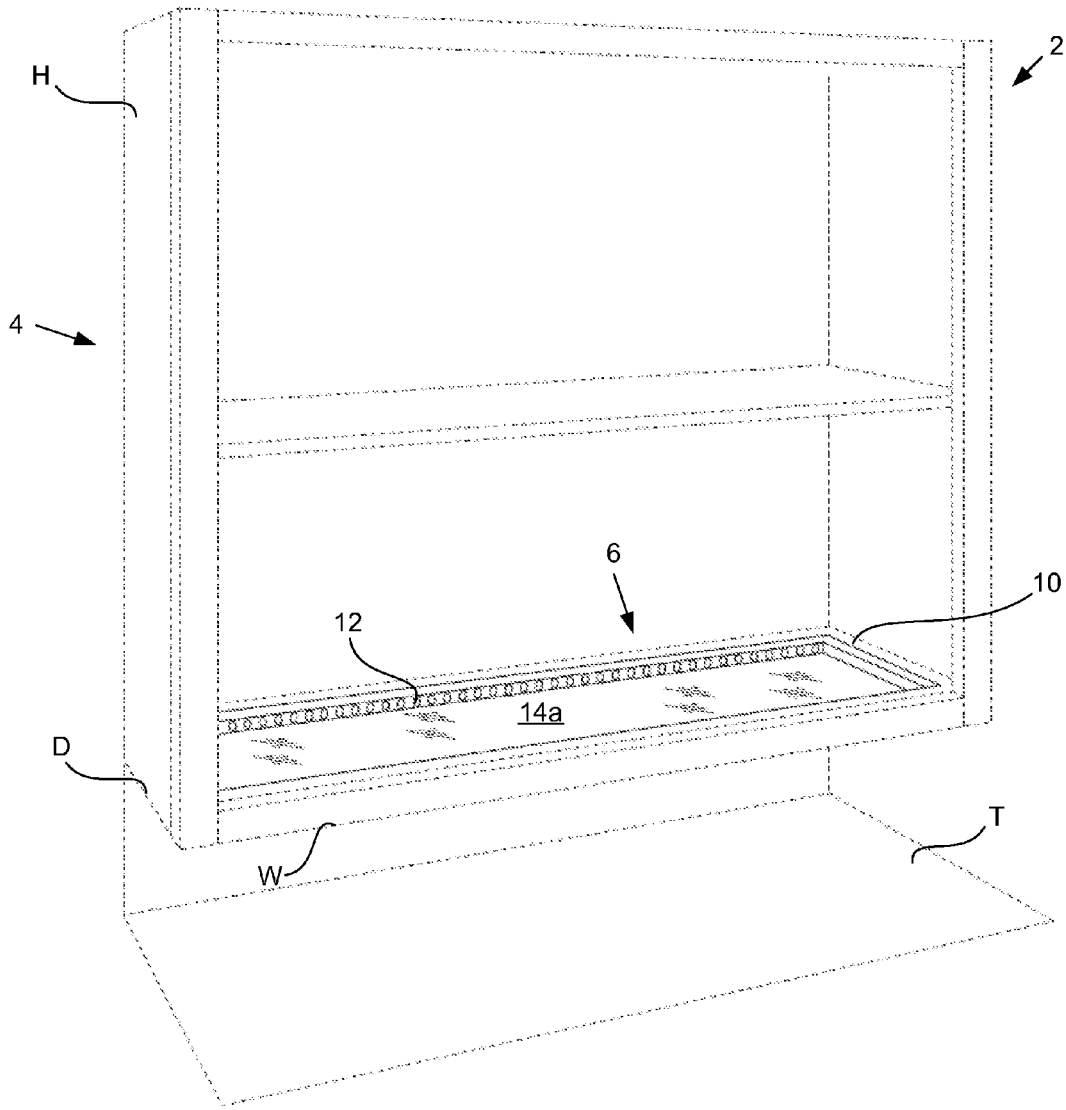
FIGS. 1*a* and 1*b* illustrate one example of a cabinet as disclosed herein.
Figure 1B:
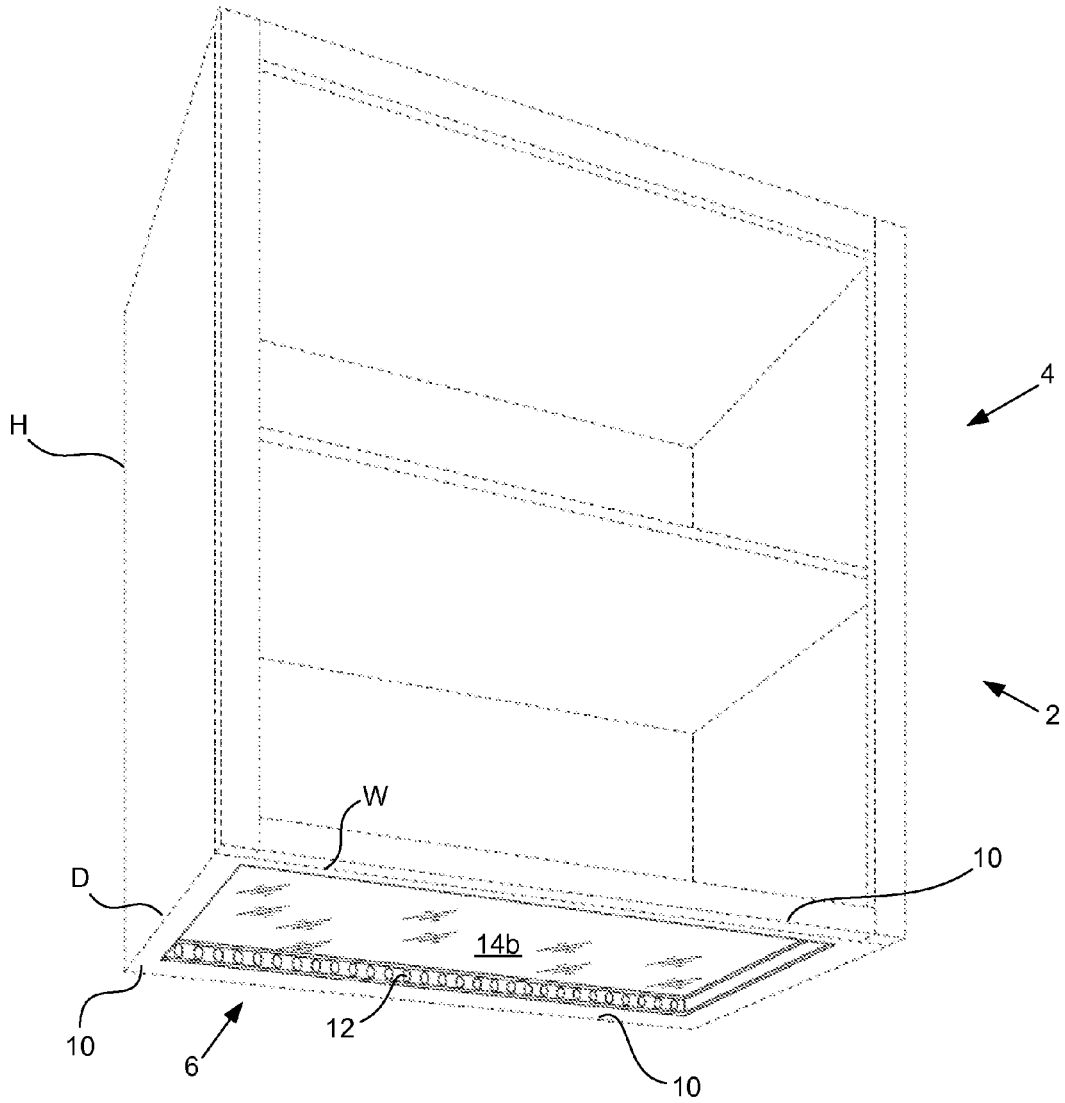

The current disclosure is directed to, inter alia, a variety of cabinets and light systems for cabinets. FIG. 1*a* illustrates cabinet 2, one example of a cabinet as disclosed herein, from an upper perspective view. Cabinet 2 is positioned above countertop T, e.g., a waist high kitchen countertop. FIG. 1*b* shows a bottom perspective view of cabinet 2, and countertop T is not shown to facilitate viewing the underside of the cabinet. Cabinet 2, as exemplified in FIGS. 1*a* and 1*b*, is a face frame cabinet with the doors removed for illustration, but other examples include frameless cabinets, and cabinets including doors.

Referring to both FIGS. 1*a* and 1*b*, cabinet 2 includes a carcass 4. Carcass 4 may have a variety of depths D, widths W, and heights H. Cabinet 2 also includes a light-emitting-translucent-shelf (LETS) 6 positioned within carcass 4. LETS 6 includes at least one strip 10, at least one light source 12, and a translucent sheet 14*a*, which may serve as the largest shelf surface of the LETS. Wooden strips may also provide some shelf surface. Translucent sheets may have a variety of surface areas relative to the depth D and width W of the carcass. For example, surface areas may include at least one of: greater than 0.5 DW, greater than 0.8 DW, and greater than 0.9 DW.

The thickness of the translucent sheet may also vary from example to example. In many examples, e.g. those including acrylic, the translucent sheet will have a thickness in the range of about 0.2 to about 0.3 inches, more typically, about 0.21 to 0.24 inches, and about 0.22 inches. Other examples include other thicknesses. Translucent sheets may also have additional effects, e.g. frosting, etching, protection of lights, etc. As used herein "translucent" is also intended to include transparent. LETS may also include a lower translucent sheet, e.g. 14*b*.

Figure 2:
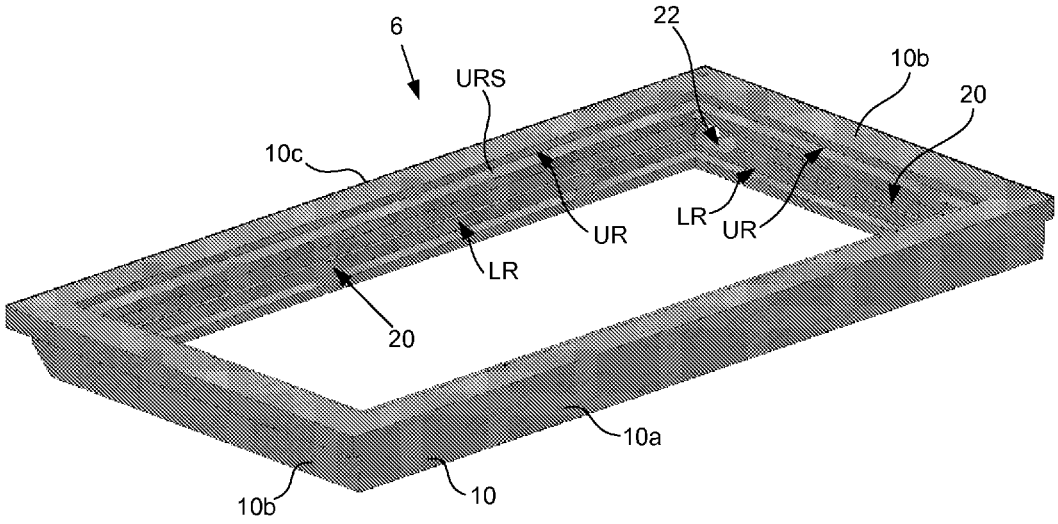
FIG. 2 illustrates a partial view of a light-emitting-translucent-shelf (LETS) as disclosed herein.

LETS construction may vary from example to example. FIG. 2 illustrates a partial view of an isolated LETS 6, which is one example of LETS construction disclosed herein. In FIG. 2, the at least one light source and translucent shelve have been removed to facilitate viewing. In this example, LETS 6 includes front strip 10*a*, a pair of side strips 10*b*, and rear strip 10*c*. The strips may be considered to form a frame of the LETS. In many examples, at least one of the strips will be wood, e.g., solid wood, including cherry, maple, oak, pine, etc. More typically, all of the strips will be wood.

Front strip 10*a*, side strips 10*b* and rear strip 10*c* may each define a lower rabbet LR and an upper rabbet UR. As seen, the upper rabbet is shaped to maintain a translucent sheet rested thereon in a horizontal position. Lower rabbets may similarly be shaped to maintain a light source, a translucent sheet, a light source and a translucent sheet, or they may have some other shape. In this example, the upper and lower rabbets run the majority of the length of their respective strips, but in other examples, shorter or partial rabbets will be sufficient to support a sheet. In some examples, the upper rabbet will be slightly recessed relative to the lower rabbet, e.g. to allow a lower translucent sheet to pass through the upper rabbet and be positioned on the lower rabbet. Further, in some examples, the upper rabbet may have a greater support surface URS, thereby transferring more weight from the upper sheet to the strip. In other examples, fewer rabbets may be defined, e.g., rabbets may be only defined in the front and or rear strip, or additional structures may be used to support sheets.

Using the wooden strip structures disclosed herein, a manufacturer can assemble the complete cabinet and LETS on the assembly line and thereby provide an assembled product. The wooden strip structures can be stained or finished to match the stain, finish, or color of the cabinet, e.g. the interior color. In some examples, strips and/or cabinet may be left raw to allow for finishing at some point downstream from manufacture, e.g. by the customer.

Typically the LR will define, at least in part, a horizontally positioned light-channel 20 for receiving a light source, e.g., at least one light 12. The light-channel in the front strip and left-side strip may be considered similar to the light-channel of the rear and right-side strips. In some examples, only one of the strips may define a light channel, e.g., the front strip or the rear strip. Further, light-channels may run the full length of the strip or may be located in at least a portion of the strip. Similarly, light-sources may be positioned in any of the light-channels, any portion of the light channels, or all of the light-channels. In many examples, the light-source will be positioned in at least one of the back light-channel and the front light-channel. At least one of the strips may further define a power-supply aperture, e.g., power-supply aperture 22 defined in light-channel 20 of side strip 10*b*.

In many examples, the light source will be positioned to emit light evenly across the width W of the cabinet. For example, in FIGS. 1*a* and 1*b*, lights 12 are evenly distributed across the width W of carcass 4. Light sources may vary from embodiment to embodiment. Exemplary embodiments will include a plurality of LED lights positioned within the light-channel. The concentration of lights used may vary. For example, lights, e.g. LED lights, may be positioned at a concentration of 10 lights/meter to 30 lights/meter, from 20 lights/meter to 50 lights/meter, etc.

Figure 3A:
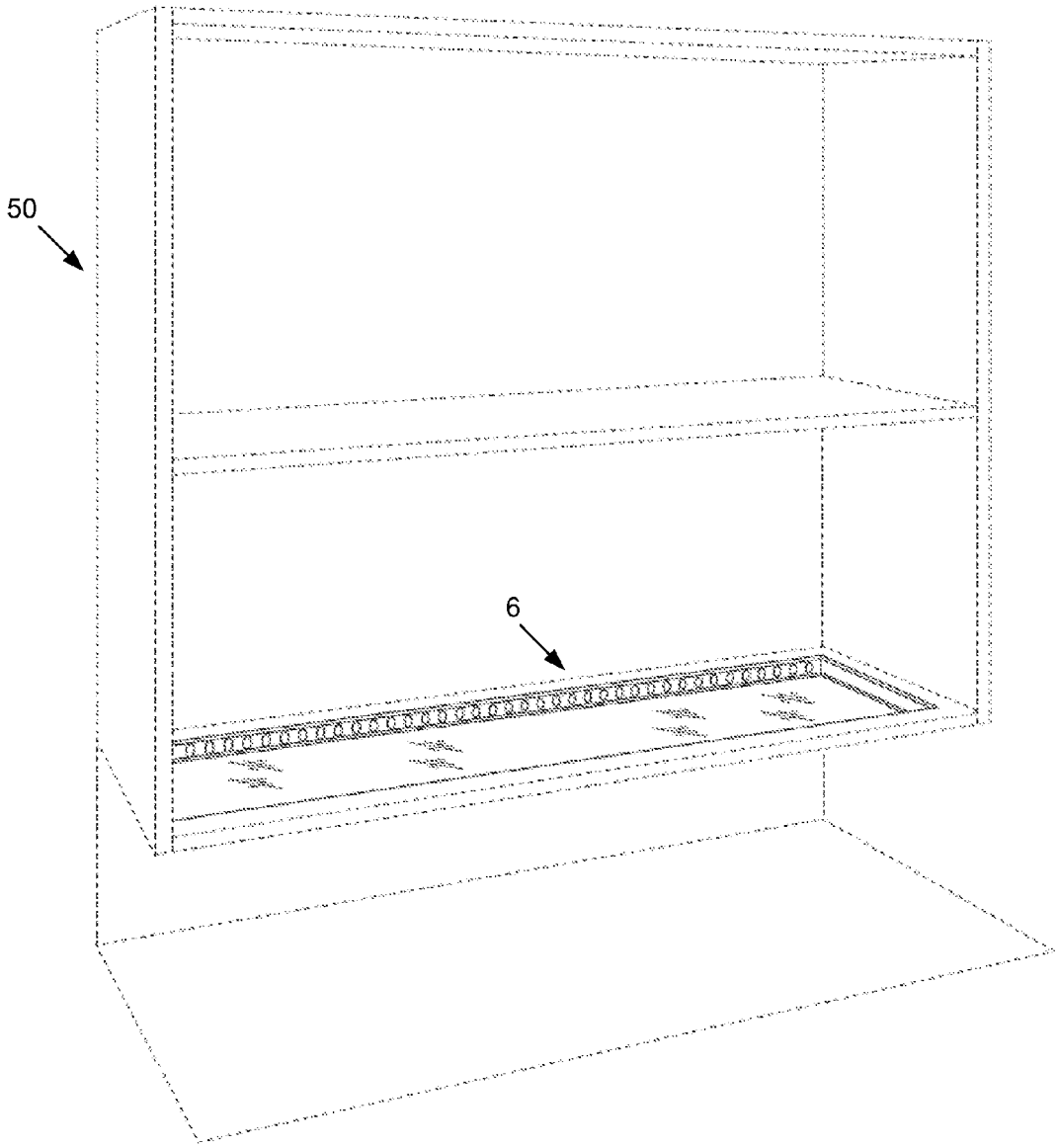
FIGS. 3*a* and 3*b* illustrate another example of a cabinet as disclosed herein.
Figure 3B:
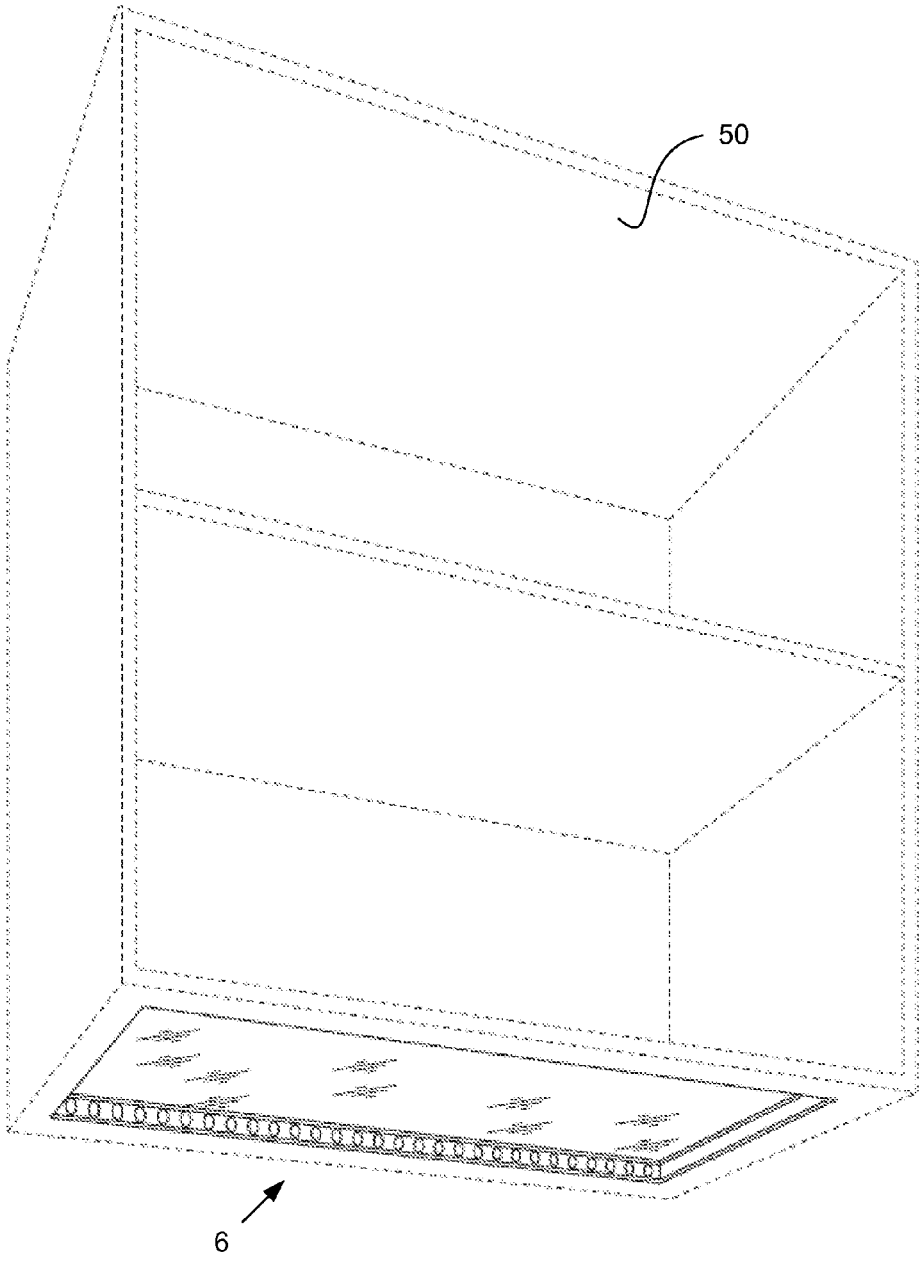
Figure 4A:
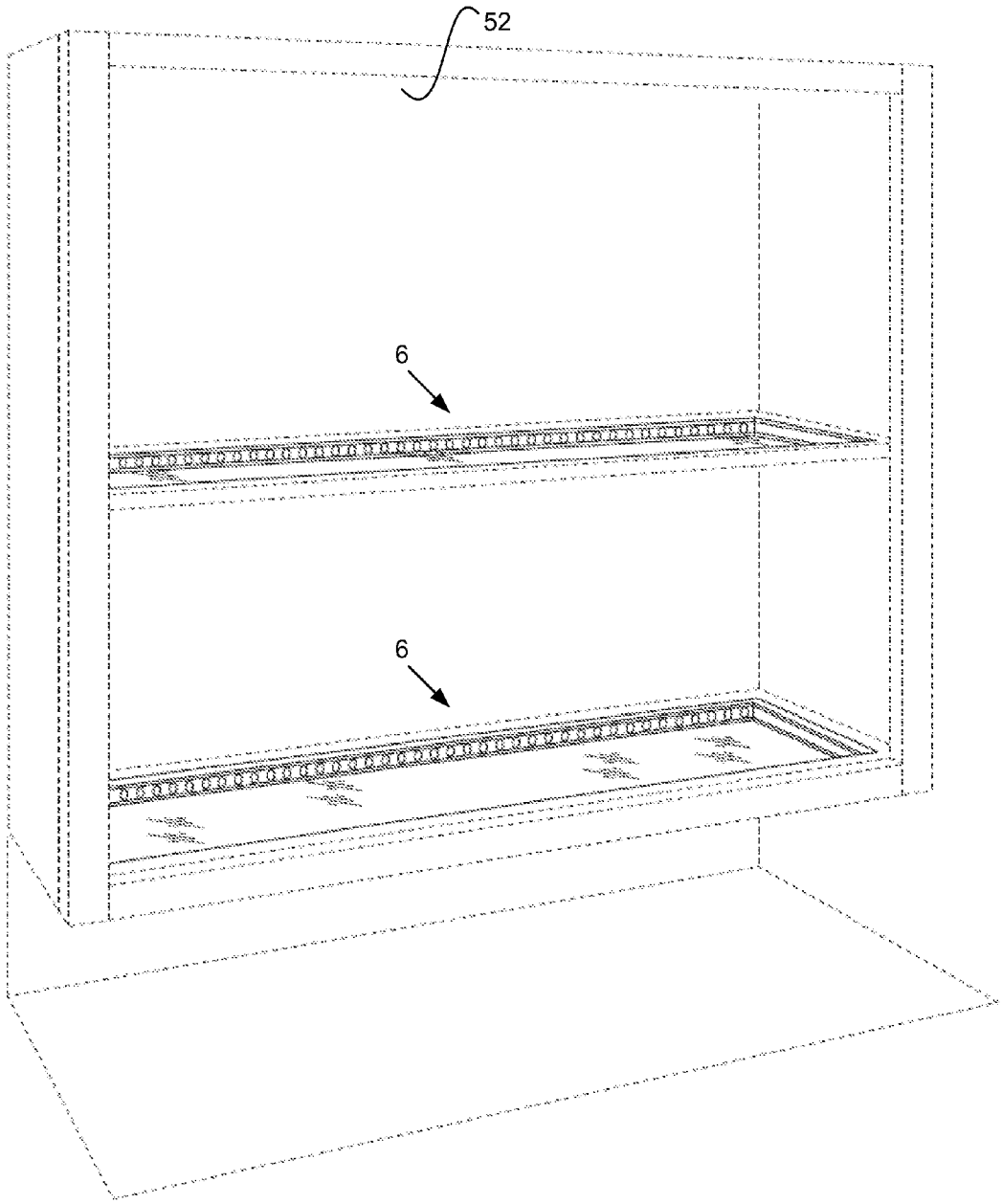
FIGS. 4*a* and 4*b* illustrate another example of a cabinet as disclosed herein.
Figure 4B:
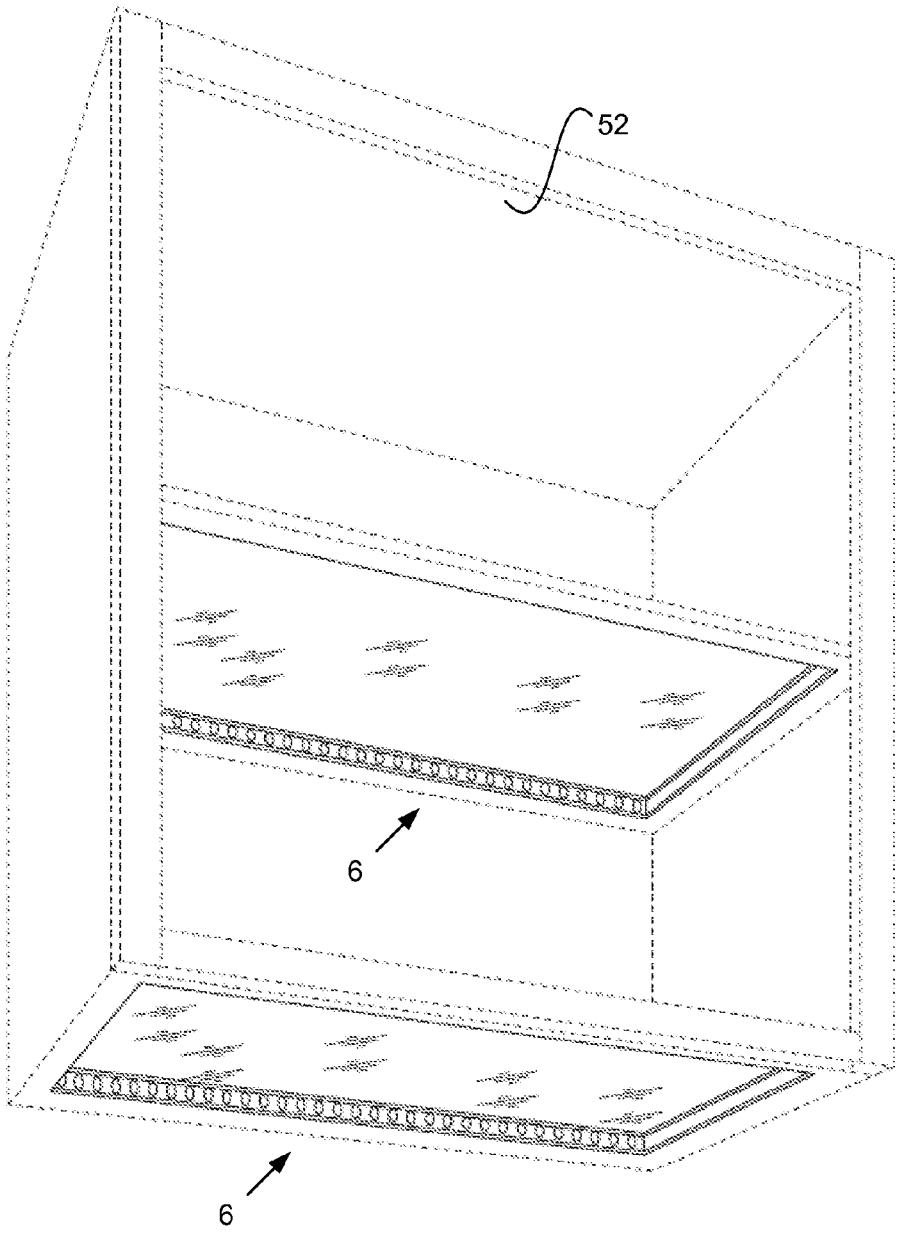
Figure 5A:
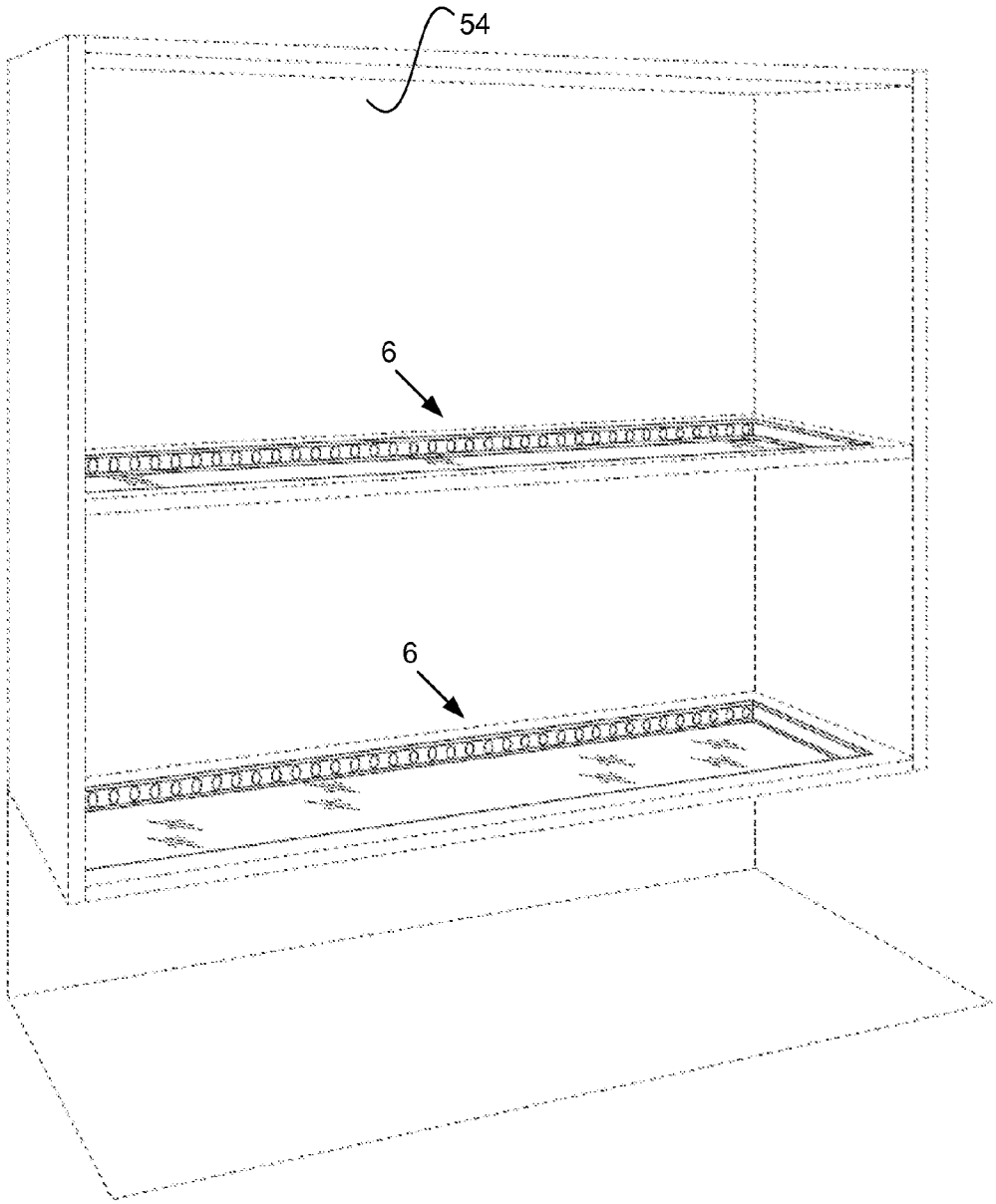
FIGS. 5*a* and 5*b* illustrate another example of a cabinet as disclosed herein.
Figure 5B:
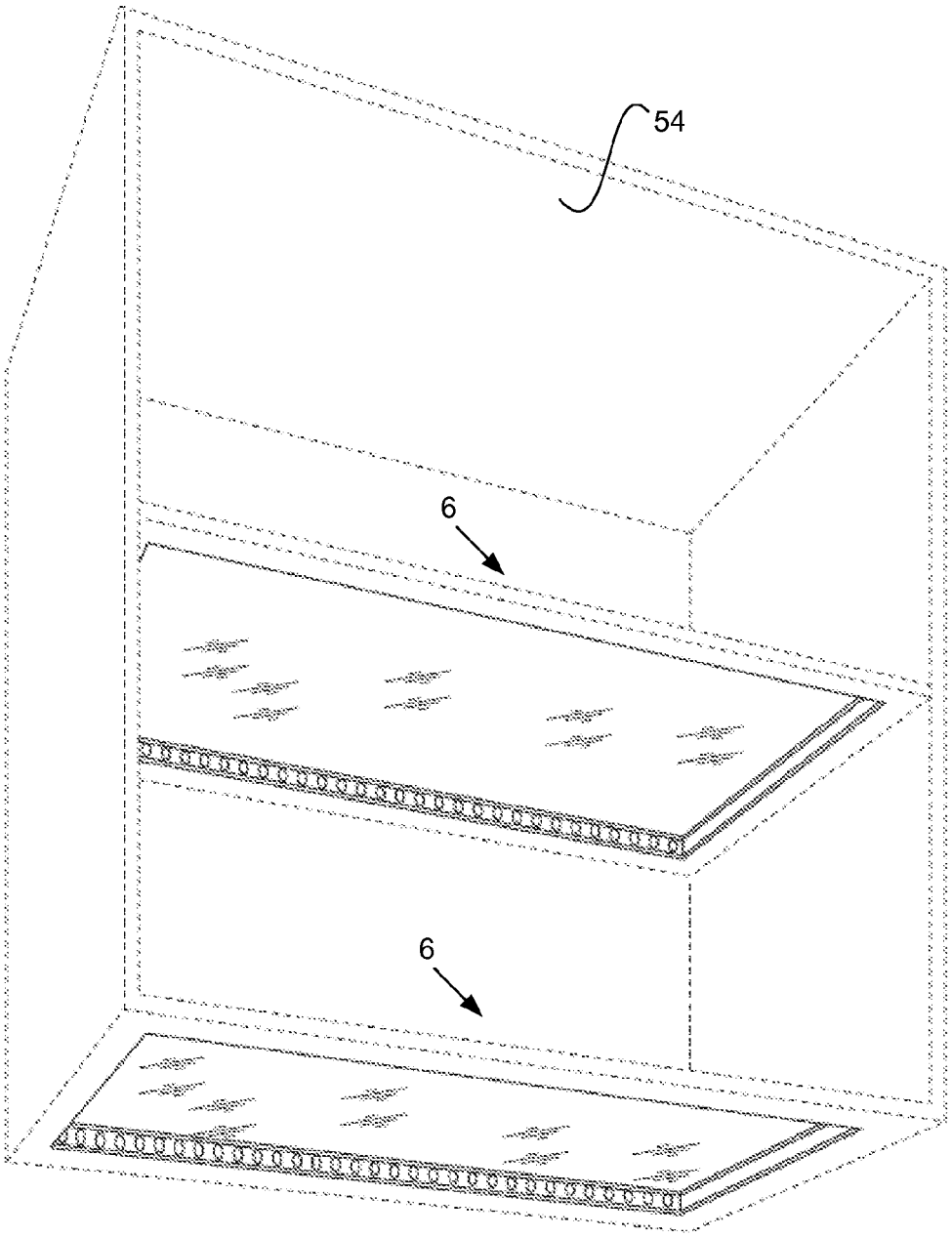

In addition to face frame cabinets, the current disclosure is also directed to frameless cabinets. FIGS. 3*a* and 3*b* illustrate examples of frameless cabinets 50 including LETS 6.

Cabinets may also include a plurality of LETS. FIGS. 4*a*, 4*b*, 5*a*, and 5*b* illustrate various examples of cabinets having a plurality of LETS, e.g. a second LETS positioned above said first LETS. In other examples, cabinets may include additional LETS.

LETS may be positioned in a variety of locations in the carcass. In many examples, the LETS is the bottom-most shelf of the cabinet. As such, in many examples, carcasses will have a translucent bottom and will not include a non-translucent (or opaque shelf), as is known in the art. LETS may be positioned in the top of the cabinet, and in such examples, carcasses may have a translucent top and may not include a non-translucent (or opaque top). Somewhat similarly, in many examples, carcasses may include at least one of non-translucent side walls, and a non-translucent top. Cabinets may also commonly include doors, e.g., a pair of non-translucent doors.

Figure 6A:
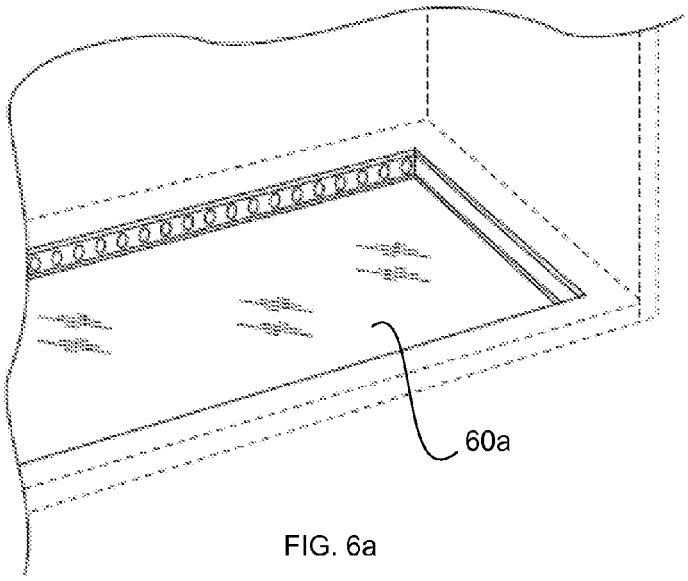
FIGS. 6*a* and 6*b* illustrate partial close-up views of LETS examples.
Figure 6B:
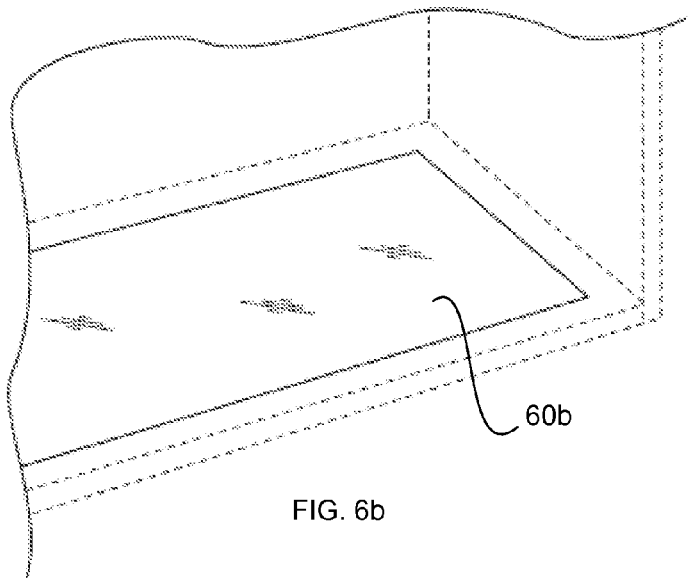

FIGS. 6*a* and 6*b* illustrate two examples of LETS 60*a* and 60*b*. As seen, both LETS 60*a* and 60*b* include translucent sheets, as used herein, with LETS 60*a* including a translucent sheet that is also transparent.

Figure 7:
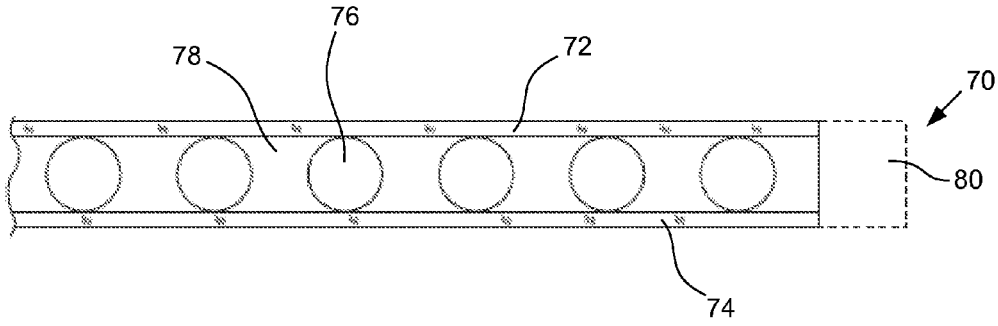
FIG. 7 illustrates a cutaway LETS example view.

FIG. 7 illustrates a cutaway, partial view of LETS 70, another example of a LETS as disclosed herein. In this view, upper translucent sheet 72 and lower translucent sheet are supported by some portion of strip 80, or some component attached to strip 80. A plurality of lights 76 are seen positioned in the light-channel 78.

Figure 8:
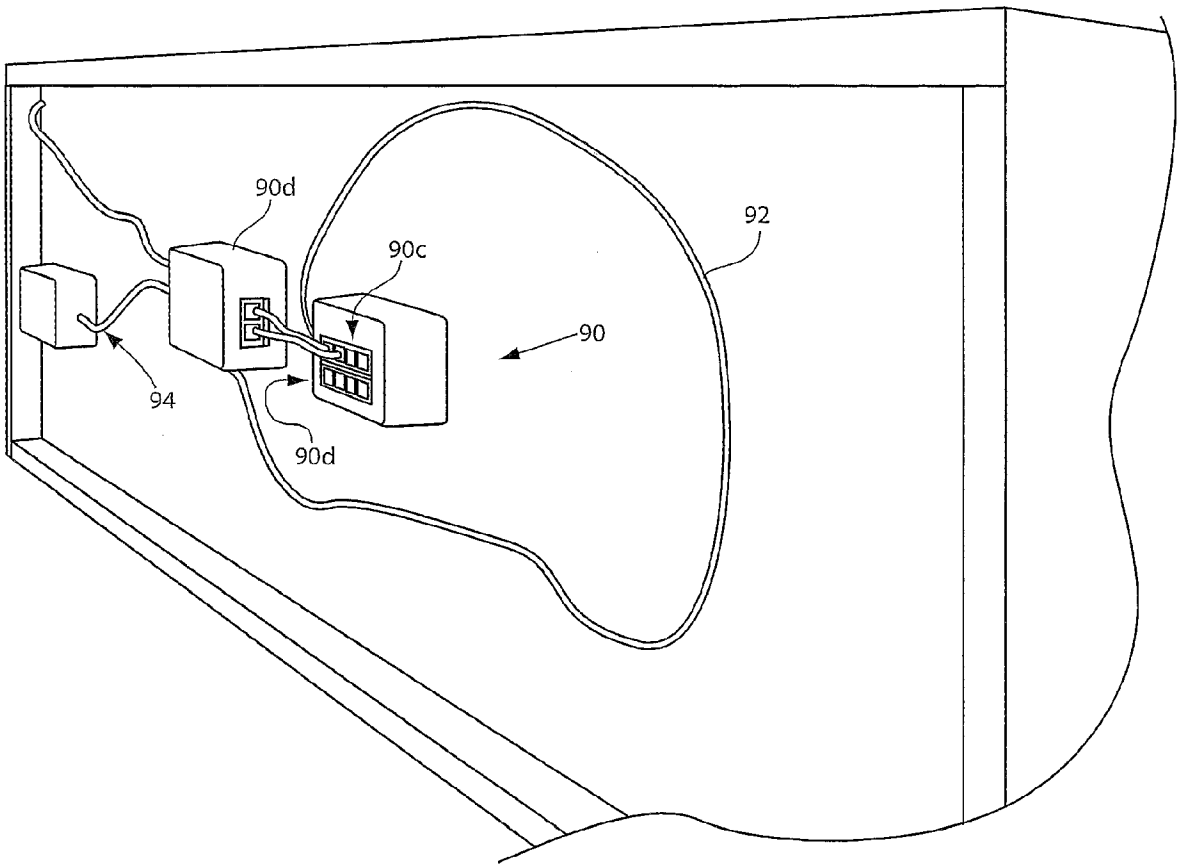
FIG. 8 illustrates a power-source interface according to an example of the disclosure.

Cabinets may also include a power source interface, e.g., for providing power to the light source. FIG. 8 illustrates power source interface example 90, which is mounted to a surface of a carcass. In other examples, interfaces may be mounted in other locations. Lights of the LETS, in this example, connect to power source interface 90 via wires 92. Power source interfaces may vary from example to example, however, they will typically include a plug (represented by structure 94) for interfacing with at least one of an AC power source or a DC power source. Power source interfaces will also typically include a panel, e.g panel 90*b*, for receiving the plug, e.g. 90*c*, configured to provide power to a light source. A dimmer, e.g. 90*d*, may additionally be positioned to control the brightness or dimness of the light source.

Figure 9:
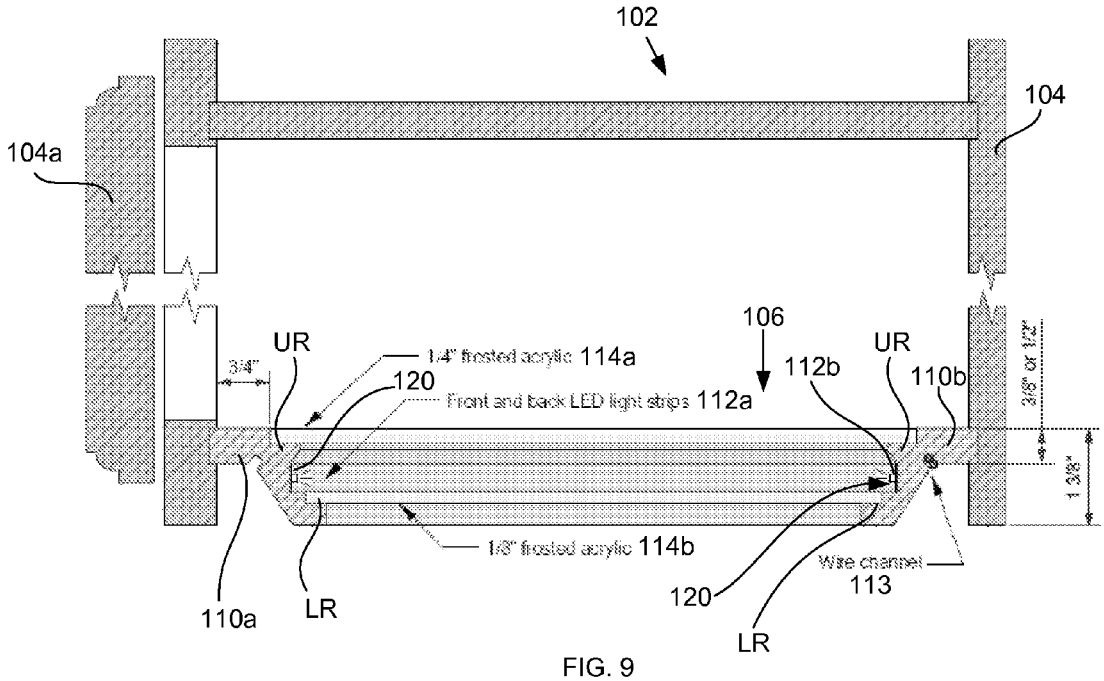
FIG. 9 illustrates a cutaway view of a cabinet example.

FIG. 9 illustrates a cut away side view of cabinet example 102. Cabinet 102 includes a carcass 104 and a cabinet door 104*a*. Cabinet 102 also includes LETS 106 having front strip 110*a*, rear strip 110*b*, front lights 112*a*, rear lights 112*b*, translucent upper sheet 114*a* and translucent lower sheet 114*b*. Translucent upper sheet 114*a* is resting on upper rabbets UR, and translucent lower sheet 114*b* is resting on lower rabbets LR. The upper and lower rabbets can also be seen defining light channels 120 for receiving the front and rear lights. The LETS may also include a wire channel 113 for receiving wire for powering the light source. Dimensions are provided by way of example only, and may vary.

Figure 10:
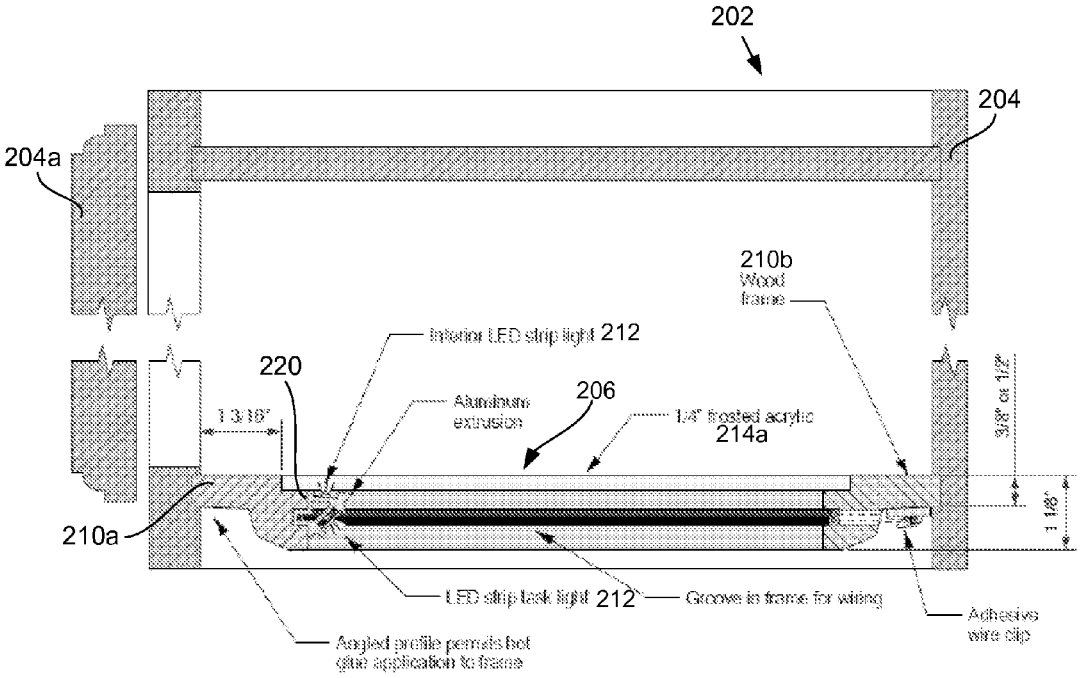
FIG. 10 illustrates a cutaway view of another cabinet example.

FIG. 10 illustrates a cut away side view of another cabinet example 202. Cabinet 202 includes a carcass 204 and a cabinet door 204*a*. Cabinet 202 also includes LETS 206 having a light channel 220 at least one light source 212 and a translucent sheet 214 horizontally positioned above light source 212*a*. In this example, the light channel 220 is defined, at least in part, by the LR of the front wooden strip 210*a*. In other examples, light channels could be defined in whole or in part by other portions of the frame, e.g. rear strip 210*b* or side strips. Cabinets may also include a wire recess, e.g. 223 including clips, etc., defined between the LETS and a back wall of the cabinet. Again, dimensions are for illustration only and may vary from example to example.

Figure 10A:
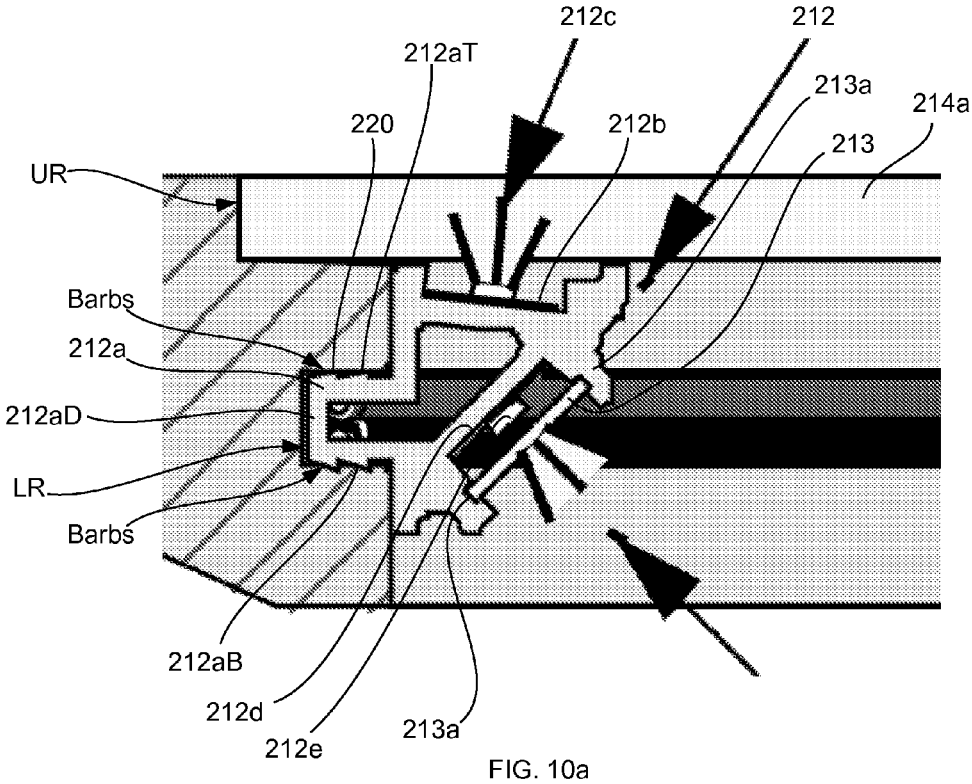
FIG. 10*a* illustrates an enlarged view of a light source example from FIG. 10.

FIG. 10*a* illustrates an enlargement of a cut away side view of a light source example, including a light frame (referred to as 212). Light frames will typically include a press arm 212*a*, a first light platform 212*b*, and a first plurality of lights 212*c*.

Press arms will typically be configured to extend into the light channel, thereby mating the light frame with the LETS, as illustrated for example, by press arm 212*a* extending into channel 220. Press arms will typically have a top surface, e.g. 212*a*T, a bottom surface, e.g. 212*a*B, and a distal end, e.g. 212*a*D. In many examples, the press arm will be configured to increase purchase with, or hold on, the light channel. For example, press arms may include any number of barbs on at least one of the top surface or bottom surface. In many examples, barb number may range from 0-5 on the top surface and 0-5 on the bottom surface. In the example shown, the top and bottom surface each include two barbs. Further, in many examples, the press arm will be configured to be readily removable, e.g. by having barb shapes, curvature, or height to allow for prying with a small lever, e.g. a screw driver, to generate a sufficient force to remove the press arm.

Light platforms will typically be configured to provide a mounting surface for a strip of lights, e.g a strip of LED lights. In the example shown, light platform 212*b* is substantially flat, but in other examples, other shapes may be used. Light frames may also include additional light platforms. For example, light frame 212 includes a second platform 212*d* and a second plurality of lights 212*e*. In this example, light frame 212 also includes a diffuser lens 213. Diffuser lenses may be used, for example, instead of, or in addition to, translucent sheets. Diffuser lenses may be mounted in a variety of ways to diffuse light, including, for example, the use of diffuser recesses 213*a* positioned in the frame to receive the diffuser lens. Diffuser lenses may additionally provide some protection to the lights.

Figure 10B:
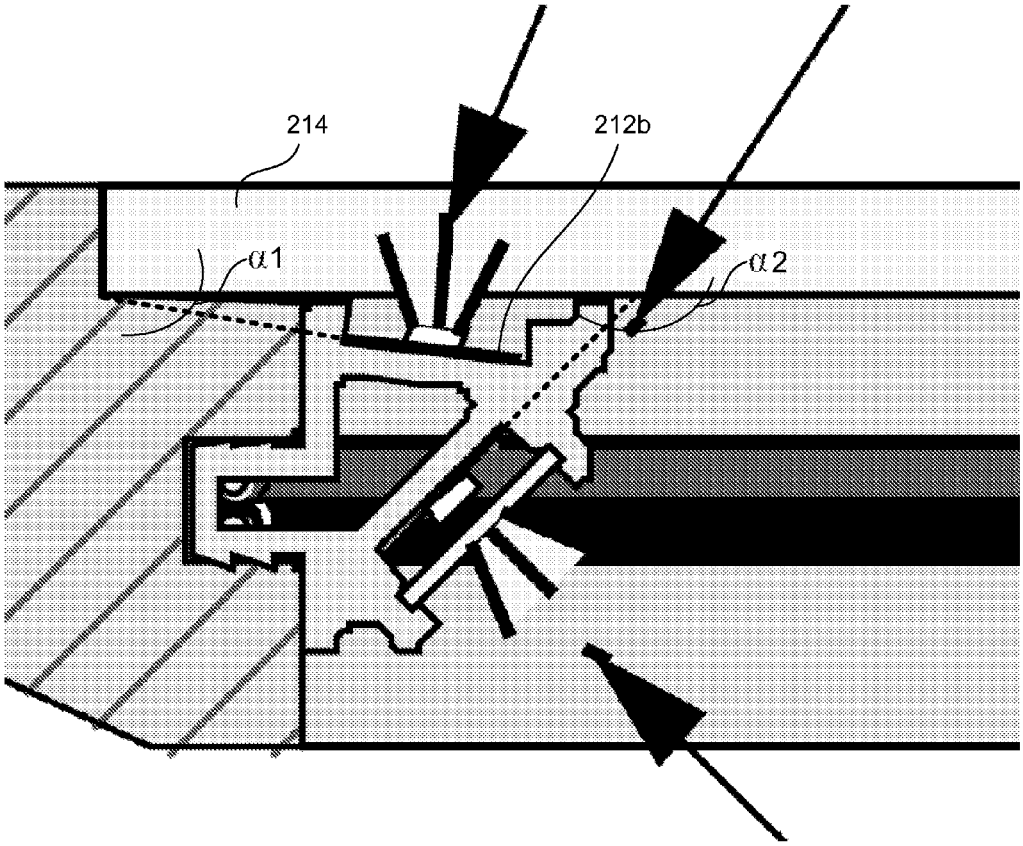
FIG. 10*b* illustrates an enlarged view of a light source example from FIG. 10 useful for illustrating light platform orientation.

FIG. 10*b* shows an enlargement of FIG. 10*a* useful for illustrating the positioning of light platforms of the light frame in some examples. For example, first platform 212*b* may define an angle $\alpha 1$ with horizontal translucent sheet 214. Angle $\alpha 1$ may vary from example to example, e.g. in the range of 0° to 150°. For examples having a single light platform, for example, angle $\alpha 1$ may be about 90°, e.g. to project light both upwardly and downwardly. For examples having two light platforms, e.g., similar to the illustration, the first light platform may define angle $\alpha 1$ in the range of 1° to 20°, and the second light platform may define angle $\alpha 2$ in the range of 100° to 180°. More typically, $\alpha 1$ in the range of 1° to 10°, and the second light platform may define angle $\alpha 2$ in the range of 100° to 140°, which applicants believe may provide improved illumination characteristics for many applications. In one example, $\alpha 1$ is approximately 5° and $\alpha 2$ is approximately 135°.

Light frame construction may vary from example to example. In many examples, it may include extruded aluminum, for example. Other constructions may include polymers, etc.

Figure 11:
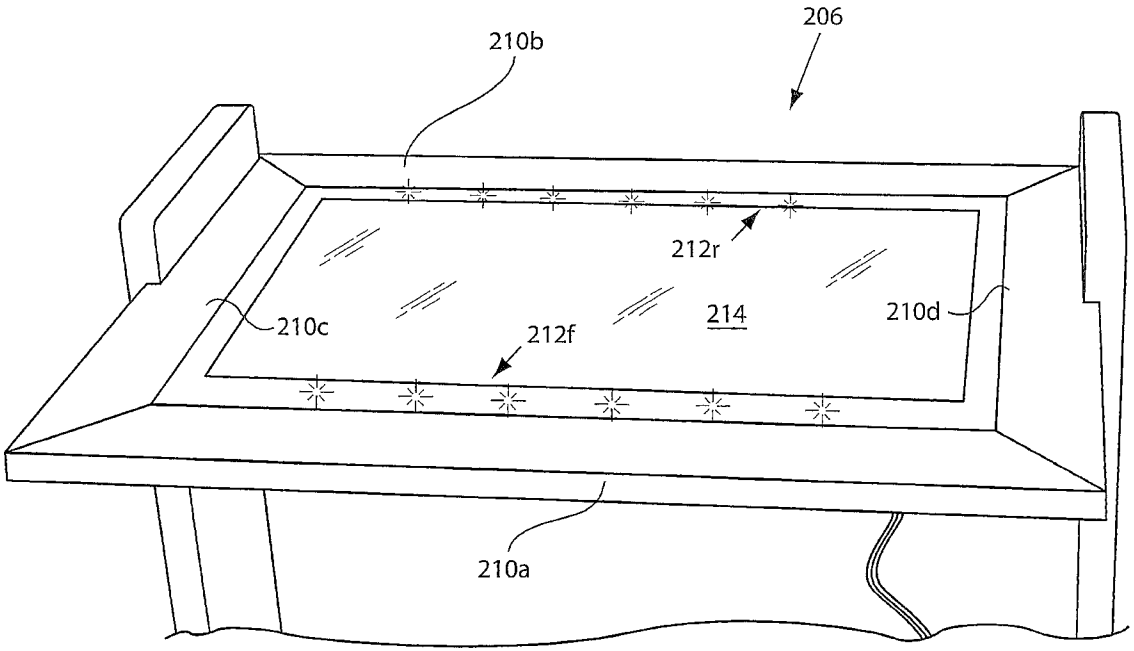
FIG. 11 illustrates a top perspective view of a LETS.

FIG. 11 illustrates a top perspective view of LETS 206 suspended for illustration. A front light source 212*f* is interfaced with front wooden strip 210*a*, and a rear light source 212*r* is interfaced with rear strip 210*b*. Side light sources could also be interfaced with at least one of side strips 210*c* and 210*d*. Translucent sheet 214 is also visible. In many examples, translucent sheets will be positioned so that their top surface is flushly mounted relative to the top surface of at least one of the front strip, rear strip, and side strips.

Figure 12:
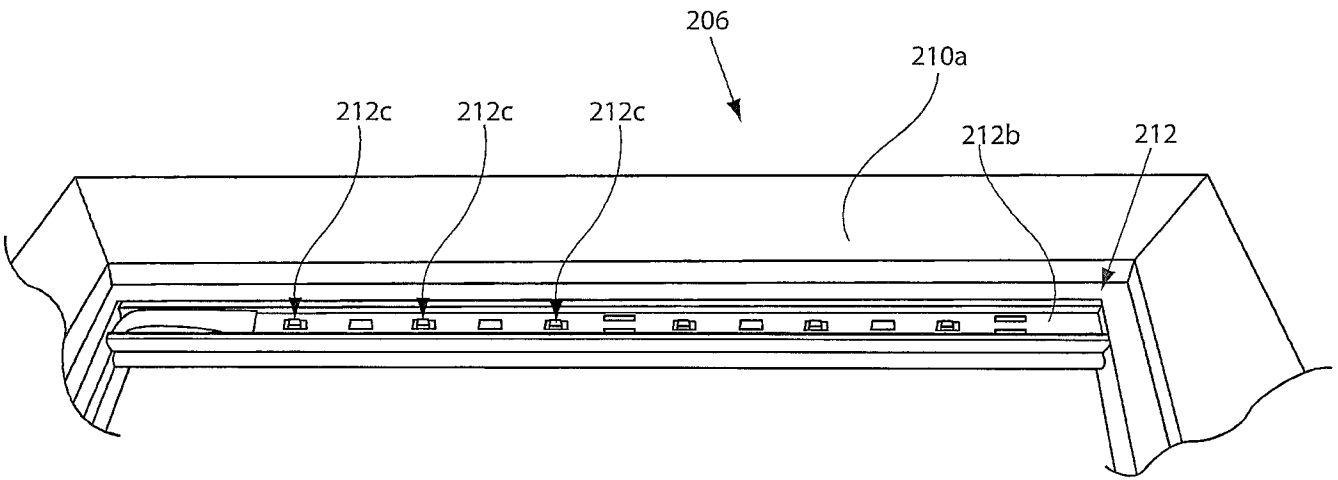
FIG. 12 illustrates an enlarged view of a LETS example with a translucent shelf removed for visualization.

FIG. 12 illustrates an enlarged top perspective view of a LETS example 206, with translucent sheet 214 removed to facilitate viewing of light frame 212 interfaced with strip 210*a*. Light platform 212*b* is visible as is a plurality of lights 212*c*.

Figure 13:
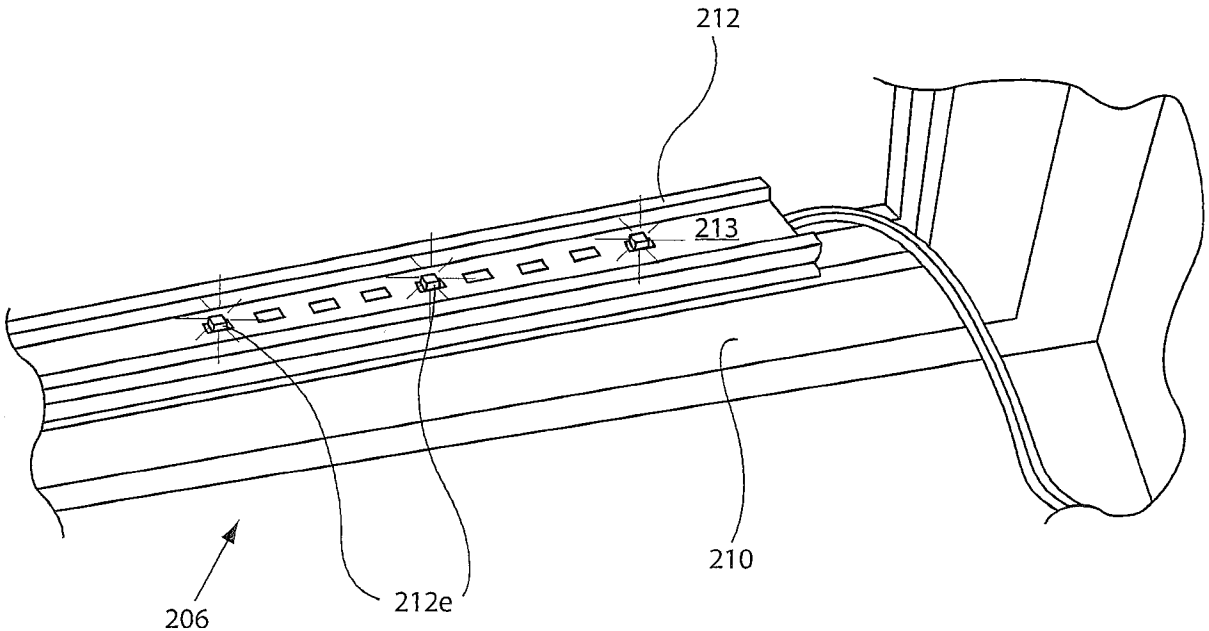
FIG. 13 illustrates an enlarged bottom perspective view of a LETS.

FIG. 13 illustrates an upward looking perspective view of the bottom of LETS example 206. Light frame 212 is shown as interfaced with strip 212 and a plurality of lights 212*e* positioned behind a diffuser 213 are visible.

Figure 14:
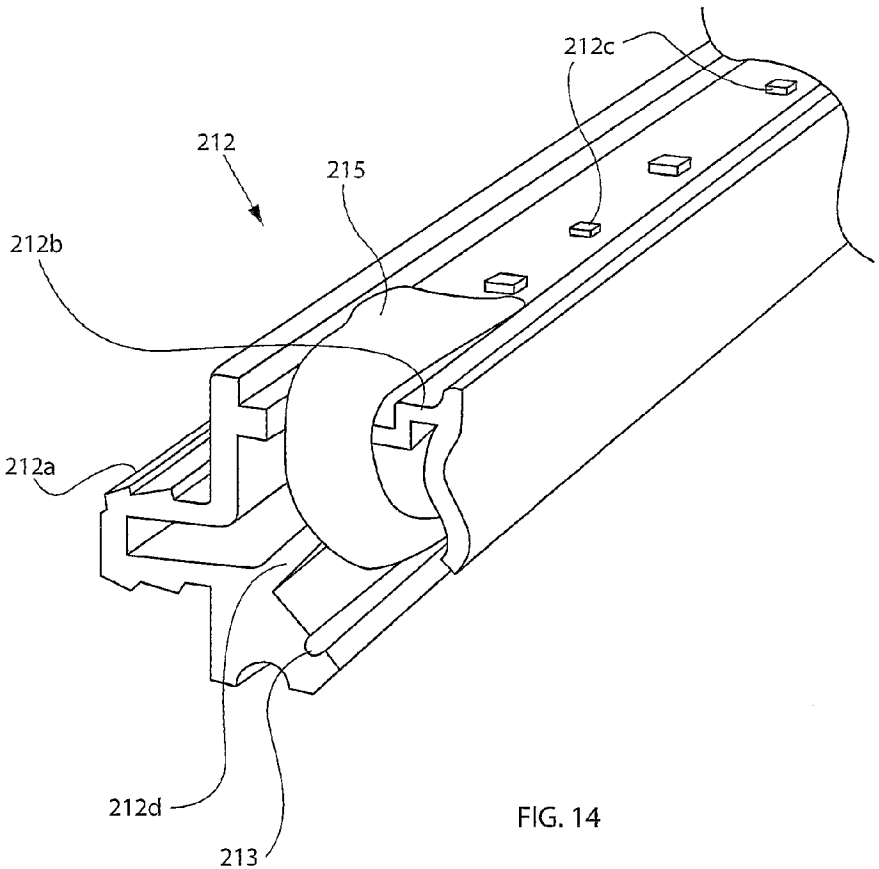
FIG. 14 illustrates a perspective view of a light frame example.

FIG. 14 illustrates a perspective view of light frame example 212. From this view, press arm 212*a*, first light platform 212*b*, and a first plurality of lights 212*c* are visible. Also visible is second platform 212*d* and diffuser 213. Electronic communication between the first plurality of lights 212*c* and the second plurality of lights (not visible at this angle) is established via connection 215, e.g. a wire.

Figure 15:
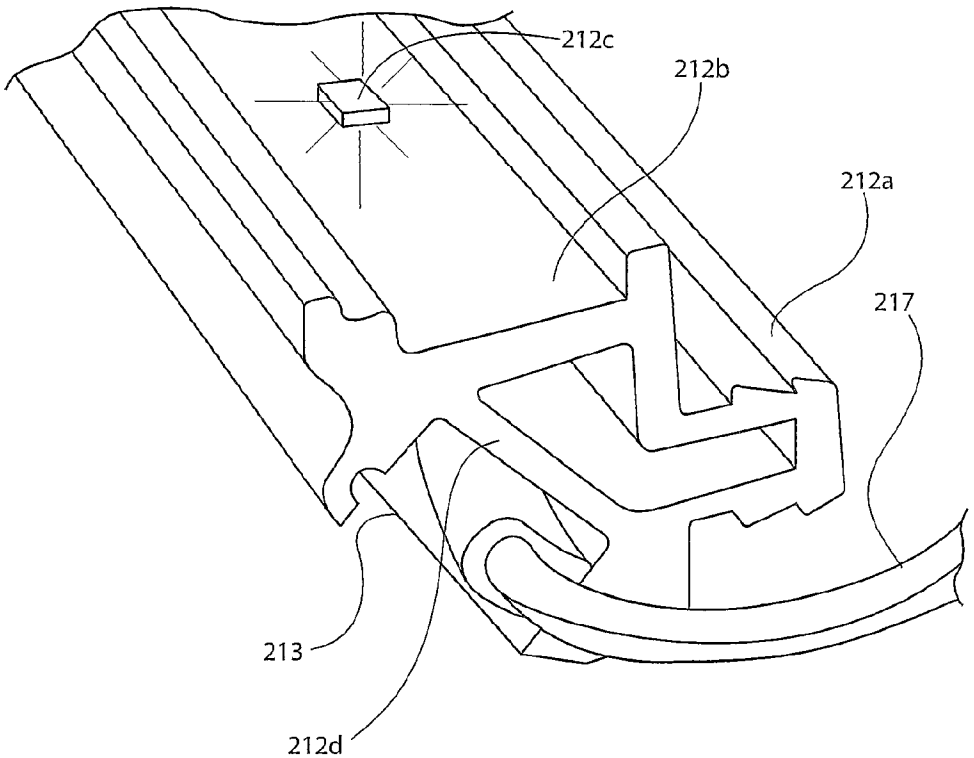
FIG. 15 illustrates another perspective view of a light frame example.

FIG. 15 illustrates another perspective view of light frame example 212. From this view, press arm 212*a*, first light platform 212*b*, and first plurality of lights 212*c* are visible. Also visible is second platform 212*d*, diffuser 213, and illumination created by the second plurality of lights. Connection 217, e.g. a wire, for connecting the second plurality of lights to a power source. Connection 215 of FIG. 14 establishes a downstream connection with first plurality of lights 212*c*. In other examples, power sources may connect independently to each of the first and second plurality of lights, or additional lights; the second plurality of lights can be downstream from the first plurality of lights, etc.

Figure 16:
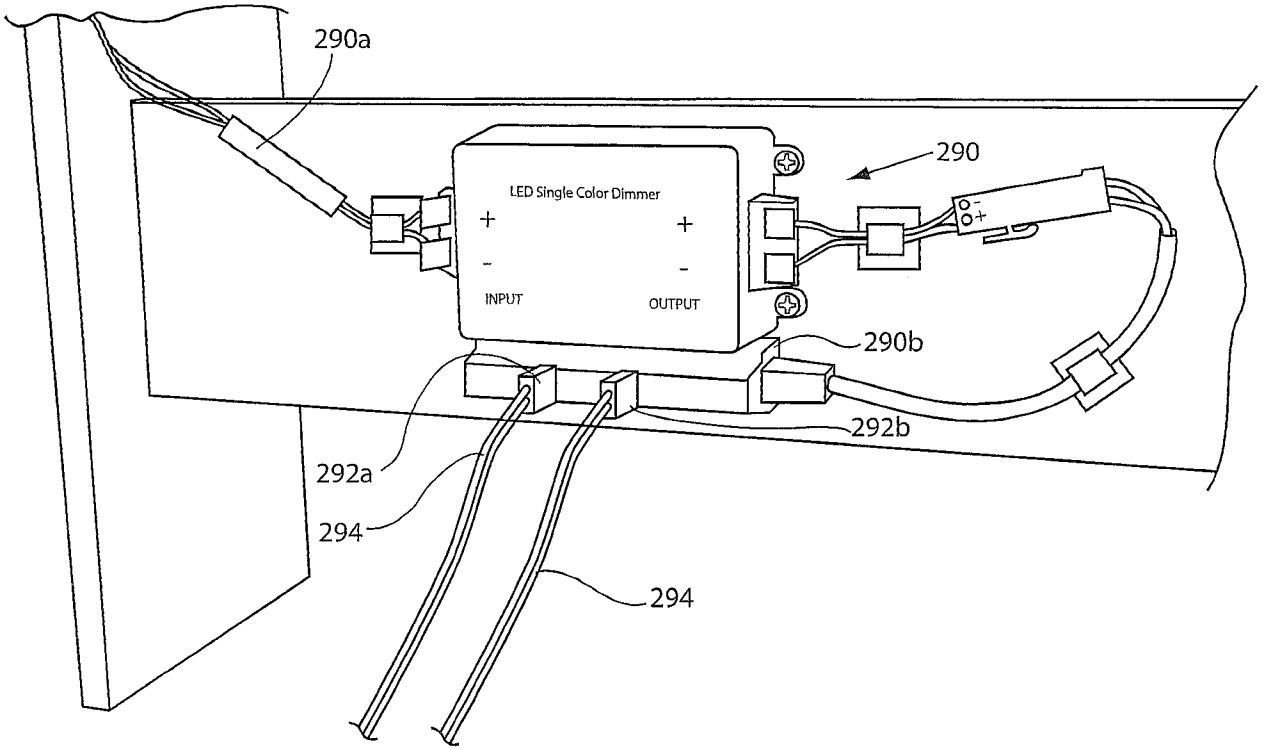
FIG. 16 illustrates a power interface example.

FIG. 16 illustrates another power source interface example 290, which is mounted to an exemplary carcass surface. Power source interface 290 includes a plug 290*a* for removably interfacing with at least one of an AC power source or a DC power source (not shown). Power source interface 290 also includes panel 290*b*, for receiving a plug, e.g. 292*a* or 292*b*, of a light source. Connections 294 connect plugs to light sources. Accordingly, a variety of LETS or a variety of different light sources within a single LETS may be easily connected to or disconnected from communication with a power supply.

In many applications, a plurality of cabinets will be used, e.g., in a kitchen. In such applications, it is not necessary for every cabinet to include a power source interface. For example, the cabinet having the power source interface may include an additional interface, e.g., 90*b*, for connecting to adjacent cabinets having additional LETS and providing power to the additional LETS. Using such a configuration, wires connected to light sources of the various LETS, e.g., similar to wires 92, may be connected to the additional interfaces of the power source interface. A variety of switches may be used to operate the light source. For example, some switches may be door activated, e.g., on the hinge or pressure switches. Light sources may also be activated by other manually activated switches, e.g., positioned on the cabinet or on a wall. Operation may also be wireless, timed, light sensitive, etc.

Using any of the cabinets described herein, a new functionality is created that allows for improved visualization within and below the cabinet. Cabinets as disclosed herein also create a new aesthetic, which applicants believes may improve salability. Further, based on the teachings contained herein LETS components, such as translucent sheets and light frames, are easily separable from the remainder of the LETS, thereby allowing for at least one of ease of staining of wooden components and repairing and accessing light sources.

In addition to cabinets, the disclosure is also directed to LETS for use with cabinets, e.g. any LETS based on the disclosure, and light frames, e.g. any light frame based on the disclosure. Further, it should be clear that structures from the various embodiment examples are not intended to be mutually exclusive, and structures or features may be interchanged in a variety of ways in light of applicants' broad disclosure.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

What is claimed is:

1. A cabinet comprising:

a carcass having a depth D, a width W and a height H, and a first light-emitting-translucent-shelf (LETS) positioned in the carcass, wherein the LETS includes at least one light-channel defined by a wooden component, at least one light source positionable within the at least one light-channel, and a translucent sheet horizontally positioned above the at least one light source.

2. The cabinet of claim 1, wherein the at least one light-channel is defined by at least one of a wooden front strip and a wooden rear strip.

3. The cabinet of 1, wherein the at least one light-channel is defined, at least in part, by a lower rabbet.

4. The cabinet of claim 1, wherein the at least one light-channel is horizontally positioned and extends from one side of the LETS to an opposite side of the LETS.

5. The cabinet of claim 1, wherein the top surface of the press arm includes a number of barbs in the range of 0 to 5, and the bottom surface of the press arm includes a number of barbs in the range of 0 to 5.

6. The cabinet of claim 1, wherein the first plurality of LED lights are positioned to emit light evenly across the width W of the cabinet.

7. The cabinet of claim 1, wherein the first plurality of LED lights are positioned at a concentration in the range of about 20 lights/meter to 50 lights/meter.

8. The cabinet of claim 1, wherein the first light platform defines an angle $\alpha 1$ with the horizontal translucent sheet of the LETS in the range of 0° to 150°.

9. The cabinet of claim 1, wherein the first light platform defines an angle $\alpha 1$ with the horizontal translucent sheet of the LETS in the range of 80° to 100°.

10. The cabinet of claim 1, wherein the first light platform defines an angle $\alpha 1$ with the horizontal translucent sheet of the LETS in the range of 1° to 10°, and wherein the second light platform defines an angle $\alpha 2$ with the horizontal translucent sheet of the LETS in the range of 100° to 140°.

11. The cabinet of claim 10, wherein the first plurality of LED lights are positioned downstream from the second plurality of lights.

12. The cabinet of claim 1, wherein the light frame further includes diffuser recesses defined to position a diffuser lens in front of the second plurality of LED lights, and a diffuser lens received by the diffuser recesses.

13. The cabinet of 1, further including a power source interface mounted to the carcass of the cabinet, the power source interface including a power supply plug for removably connecting to at least one of an AC power source and a DC power source, and a panel for removably receiving a plug of at least one light source.

14. The cabinet of claim 13, wherein the power supply plug and the panel of the of the power source interface are removably connectable, and, optionally, include a dimmer positioned in between the power supply plug and the panel of the power source interface.

15. The cabinet of claim 13, wherein the LETS further includes a power supply aperture.

16. The cabinet of claim 1, wherein the carcass does not including a non-translucent bottom shelf and a LETS is the bottom-most shelf of the cabinet.

17. A cabinet comprising:

a carcass having a depth D, a width W and a height H, and a first light-emitting-translucent-shelf (LETS) positioned in the carcass, wherein the LETS includes a light-channel defined by a wooden front strip, wherein the light-channel is horizontally positioned and extends laterally across at least a portion of the LETS, a light frame comprising a press arm having a top surface, a bottom surface, and a distal end, and being configured to extend into the one light-channel, thereby mating the light frame with the LETS, a first light platform having a first plurality of LED lights positioned along the first light platform, a second light platform having a second plurality of LED lights positioned along the second light platform, and a translucent sheet horizontally positioned above the light frame.

18. A light frame for a light-emitting-translucent-shelf (LETS) having a light-channel defined by a wooden portion and a translucent sheet horizontally positioned above the light frame to form a surface of the shelf, the LETS to be positioned in the carcass of a cabinet, the light frame comprising:

a press arm having a top surface, a bottom surface, and a distal end, and being configured to extend into the light-channel for mating the light frame with the LETS, a first light platform having a first plurality of LED lights positioned along the first light platform, and a second light platform having a second plurality of LED lights positioned along the second light platform.

19. The cabinet of 18, further including an interface for connecting to adjacent cabinets having additional LETS and providing power to said additional LETS.

20. The cabinet of 18, wherein said carcass includes a pair of non-translucent doors.

21. The cabinet of 18, further including a second LETS positioned above said first LETS.

* * * * *

UNITED STATES PATENT AND TRADEMARK OFFICE

CERTIFICATE OF CORRECTION

PATENT NO. : 8,562,167 B1
APPLICATION NO. : 13/290530
DATED : October 22, 2013
INVENTOR(S) : Peter Meier It is certified that error appears in the above-identified patent and that said Letters Patent is hereby corrected as shown below:

In the Claims

Column 7, Claim 1 should read:

A cabinet comprising: a carcass having a depth D, a width W and a height H, and a first light-emitting-translucent-shelf (LETS) positioned on the carcass, wherein the LETS includes at least one light-channel defined by a wooden component, at least one light source positionable within the at least one light-channel, and a translucent sheet horizontally positioned above the at least one light source, wherein the at least one light source includes a light frame having a press arm having a top surface, a bottom surface, and a distal end, and being configured to extend into the at least one light channel, thereby mating the light frame with the LETS, a first light platform, and first plurality of LED lights positioned along the first light platform and a second light platform and a second plurality of LED lights positioned along the second light platform, wherein the first light platform defines an angle α1 with the horizontal translucent sheet of the LETS in the range of 1 to 20° and wherein the second light platform defines an angle of α2 with the horizontal translucent sheet of the LETS in the range of 100 to 180°.

Column 8, Claim 19 should read:

A carcass depth D, a width W, and a height H, and a first light-emitting-translucent-shelf (LETS) positioned in the carcass, wherein the LETS includes a light-channel defined by a wooden front strip, wherein the light-channel is horizontally positioned and extends laterally across at least a portion of the LETS, a light frame comprising a press arm having a top surface, a bottom surface, and a distal end, and being configured to extend into the one light-channel, thereby mating the light frame with the LETS, a first light platform having a first plurality of LED lights positioned along the first light platform, a second light platform having a second plurality of LED lights positioned along the second light platform, and a translucent sheet horizontally positioned above the light frame, wherein the top surface of the press arm includes a number of barbs in the range of 0 to 5, the bottom surface of the press arm includes a number of barbs in the range of 0 to 5, the first light platform defines an angle α1

Signed and Sealed this
Eighteenth Day of March, 2014

Michelle K. Lee

Michelle K. Lee
*Deputy Director of the United States Patent and Trademark Office* with the horizontal translucent sheet of the LETS in the range of 1 to 20° for emitting light upwardly into the cabinet, the second light platform defines an angle α2 with the horizontal translucent sheet of the LETS in the range of 100 to 180° for emitting light downwardly from the LETS, and the light frame further includes a diffuser lens positioned in front of the second plurality of LED lights to diffuse light emitted downwardly from the LETS.

Column 8, Claim 21 should read:

A light frame for a light-emitting-translucent-shelf (LETS) having a light-channel defined by a wooden portion and a translucent sheet horizontally positioned above the light frame to form a surface of the shelf, the LETS to be positioned in the carcass of the cabinet, the light frame comprising: a press arm having a top surface, a bottom surface, and a distal end, and being configured to extend into the light-channel for mating the light frame with the LETS, a first light platform having a first plurality of LED lights positioned along the first light platform, and a second light platform having a second plurality of LED lights positioned along the second light platform, wherein the top surface of the press arm includes a number of barbs in the range of 0 to 5, the bottom surface of the press arm includes a number of barbs in the range of 0 to 5, the first light platform defines an angle α1 with the horizontal translucent sheet of the LETS in the range of 1 to 20° for emitting light upwardly into the cabinet, the second light platform defines an angle α2 with the horizontal translucent sheet of the LETS in the range of 100 to 180° for emitting light downwardly from the LETS, and the light frame further includes a diffuser lens positioned in front of the second plurality of LED lights to diffuse light emitted downwardly from the LETS.

UNITED STATES PATENT AND TRADEMARK OFFICE

CERTIFICATE OF CORRECTION

PATENT NO. : 8,562,167 B1
APPLICATION NO. : 13/290530
DATED : October 22, 2013
INVENTOR(S) : Peter Meier It is certified that error appears in the above-identified patent and that said Letters Patent is hereby corrected as shown below:

In the Claims

Column 7, Claim 1, lines 17-26, should read:

A cabinet comprising: a carcass having a depth D, a width W and a height H, and a first light-emitting-translucent-shelf (LETS) positioned on the carcass, wherein the LETS includes at least one light-channel defined by a wooden component, at least one light source positionable within the at least one light-channel, and a translucent sheet horizontally positioned above the at least one light source, wherein the at least one light source includes a light frame having a press arm having a top surface, a bottom surface, and a distal end, and being configured to extend into the at least one light channel, thereby mating the light frame with the LETS, a first light platform, and first plurality of LED lights positioned along the first light platform and a second light platform and a second plurality of LED lights positioned along the second light platform, wherein the first light platform defines an angle α1 with the horizontal translucent sheet of the LETS in the range of 1 to 20° and wherein the second light platform defines an angle of α2 with the horizontal translucent sheet of the LETS in the range of 100 to 180°.

Column 8, Claim 19, lines 55-57, should read:

A carcass depth D, a width W, and a height H, and a first light-emitting-translucent-shelf (LETS) positioned in the carcass, wherein the LETS includes a light-channel defined by a wooden front strip, wherein the light-channel is horizontally positioned and extends laterally across at least a portion of the LETS, a light frame comprising a press arm having a top surface, a bottom surface, and a distal end, and being configured to extend into the one light-channel, thereby mating the light frame with the LETS, a first light platform having a first plurality of LED lights positioned along the first light platform, a second light platform having a second plurality of LED lights positioned along the second light platform, and a translucent sheet horizontally positioned above the light frame, wherein the top This certificate supersedes the Certificate of Correction issued March 18, 2014.

Signed and Sealed this
Fifteenth Day of April, 2014

Michelle K. Lee

Michelle K. Lee
*Deputy Director of the United States Patent and Trademark Office* surface of the press arm includes a number of barbs in the range of 0 to 5, the bottom surface of the press arm includes a number of barbs in the range of 0 to 5, the first light platform defines an angle α1 with the horizontal translucent sheet of the LETS in the range of 1 to 20° for emitting light upwardly into the cabinet, the second light platform defines an angle α2 with the horizontal translucent sheet of the LETS in the range of 100 to 180° for emitting light downwardly from the LETS, and the light frame further includes a diffuser lens positioned in front of the second plurality of LED lights to diffuse light emitted downwardly from the LETS.

Column 8, Claim 21, lines 61-62, should read:

A light frame for a light-emitting-translucent-shelf (LETS) having a light-channel defined by a wooden portion and a translucent sheet horizontally positioned above the light frame to form a surface of the shelf, the LETS to be positioned in the carcass of the cabinet, the light frame comprising: a press arm having a top surface, a bottom surface, and a distal end, and being configured to extend into the light-channel for mating the light frame with the LETS, a first light platform having a first plurality of LED lights positioned along the first light platform, and a second light platform having a second plurality of LED lights positioned along the second light platform, wherein the top surface of the press arm includes a number of barbs in the range of 0 to 5, the bottom surface of the press arm includes a number of barbs in the range of 0 to 5, the first light platform defines an angle α1 with the horizontal translucent sheet of the LETS in the range of 1 to 20° for emitting light upwardly into the cabinet, the second light platform defines an angle α2 with the horizontal translucent sheet of the LETS in the range of 100 to 180° for emitting light downwardly from the LETS, and the light frame further includes a diffuser lens positioned in front of the second plurality of LED lights to diffuse light emitted downwardly from the LETS.